United States Patent [19]

Fagervold et al.

[11] 4,077,139

[45] Mar. 7, 1978

[54] SNOW WING GATE

[75] Inventors: Leroy W. Fagervold, Lodgepole; Irwin J. Solomon, Rocky Rapids; Edward Webber; Jacob Troudt, both of Stony Plain, all of Canada

[73] Assignee: County of Parkland No. 31, Stony Plain, Canada

[21] Appl. No.: 760,168

[22] Filed: Jan. 17, 1977

[51] Int. Cl.[2] ..... E01H 5/00

[52] U.S. Cl. ..... 37/41; 172/784

[58] Field of Search ..... 37/41, 42 R, 42 VL, 37/50; 172/784, 777, 113

[56] References Cited

U.S. PATENT DOCUMENTS

| | | | |
|---|---|---|---|
| 2,964,862 | 12/1960 | Lotz | 37/50 |
| 2,988,831 | 6/1961 | Burns | 37/50 |
| 3,015,261 | 1/1962 | MacDonald | 37/50 X |
| 3,373,515 | 3/1968 | Schweider | 37/50 |
| 3,374,562 | 3/1968 | Glesmann | 37/50 |
| 3,411,590 | 11/1968 | Batko | 37/50 |
| 3,422,552 | 1/1969 | Gabel | 37/50 X |
| 3,703,210 | 11/1972 | Williams | 37/50 |

FOREIGN PATENT DOCUMENTS

| | | | |
|---|---|---|---|
| 746,657 | 11/1966 | Canada | 37/50 |

*Primary Examiner*—E. H. Eickholt
*Attorney, Agent, or Firm*—Alan Swabey & Co.

[57] ABSTRACT

A snow gate attachment to be used at the end of a snow plow blade, adapted when in operation to prevent snow from discharging from the end of the blade, thereby preventing ridging when crossing driveways and the like. The gate attachment has a frame with a bracket adapted to be mounted to the end of a plow blade, the gate member proper pivotally mounted to the frame, and actuating means mounted on the frame for actuating the pivoting movement of the gate member between an operating position and an inoperative position.

4 Claims, 4 Drawing Figures

SNOW WING GATE

BACKGROUND OF THE INVENTION

1. Field of the Invention

The present invention relates to improvements in snow retaining gates for use with material handling equipment, and more particularly, to a movable gate adapted to be attached on the end of a snow plow blade.

2. Description of the Prior Art

When it is required to plow a street, there is always a problem with the formation of ridges of snow in the driveways or cross streets leading to the street being plowed. Normally, in plowing a street or road, a grader is used with a snow-wing blade mounted at an angle to the axis of the grader to one side thereof. As the vehicle advances, the snow collected along the blade gradually moves off the end of the blade leaving a ridge or small snow bank.

Various developments have been made in order to overcome the problem of ridging of snow in driveways and the like, and some of these developments are disclosed in U.S. Pat. Nos. 3,703,210, Williams et al., 1972; 3,411,590, Batko, 1968; and 3,373,515, Schneider, 1968. The Williams et al. patent shows a guillotine type snow gate adapted to move in a vertical manner relative to the blade of the snow plow and which must be custom mounted to the snow plow having two separate mounting brackets in addition to a pair of bearing rollers which must move in contact with the snow plow blade. Batko shows a pivoting type of articulated gate which must be mounted to the grader circle of a plow device and moves in an articulated pivoting manner to block the end of the mold board plow of a grader when necessary. This device precludes versatile mounting of the gate to other types of plows. The Schneider patent includes a pivoting type gate which must also be custom mounted to the grader circle and thus reduces the versatility of the gate.

SUMMARY OF THE INVENTION

It is an aim of the present invention to provide an improved and simple snow gate attachment which is unitary and is versatile in mounting on various types of snow plows.

A construction in accordance with the present invention includes a snow gate attachment including a frame, bracket means mounted on the frame for securing the frame to the free end of a plow blade, a gate member pivotally mounted to the frame, and actuating means positively actuating the pivoting movement of the gate member whereby, when the gate attachment is mounted to the end of a plow blade, the gate member can be moved between a first position with the plow blade extended forward of the plow blade in a plane parallel to the axis of the vehicle such as to collect snow and trapping it as it is being picked up by the plow blade, and a second position clear of said plow blade.

In a more specific embodiment of the present invention, there is provided the frame member with a flange attachment (adapted to be secured to the end of the plow blade), a shaft journaled to the frame and fixed to the gate member, a cylinder and piston means mounted to the frame at one end thereof and to a lever bracket fixed to the shaft at the other end thereof for rotating the shaft and thus pivoting the gate member between a first and second position, the frame and gate member normally mounted rearwardly of the plow blade permitting a clear discharge of the snow from the plow blade when the gate is in its second position.

BRIEF DESCRIPTION OF THE DRAWINGS

Having thus generally described the nature of the invention, reference will now be made to the accompanying drawings, showing by way of illustration, a preferred embodiment thereof, and in which.

DESCRIPTION OF THE PREFERRED EMBODIMENTS

Figure 1:
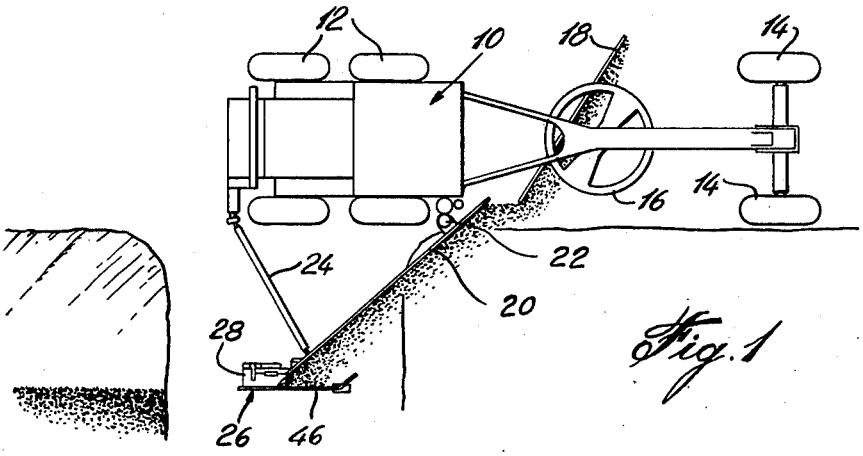
FIG. 1 is a top plan view of a grader shown schematically to which is mounted a snow gate attachment in accordance with the present invention and shown in an operative position.

Referring now to the drawings, there is shown a grader 10 having a power-driven undercarriage including wheels 12 and front wheels 14 for steering. A grader ring 16 is shown to which is mounted a mold board type plow 18. On one side of the grader and adapted to receive the discharge of the mold board 18 is a snow wing 20 pivotally mounted at 22. A control arm 24 is provided for supporting the snow wing 20.

Mounted to the end of the snow wing 20 is a snow gate attachment 26.

Figure 3:
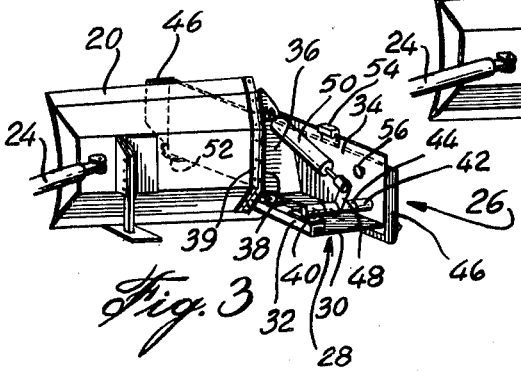
FIG. 3 is a rear fragmentary perspective view of the snow gate attachment in an operative position.
Figure 4:
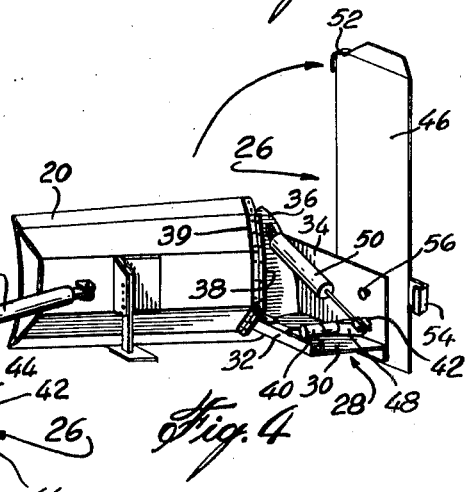
FIG. 4 is a fragmentary perspective view similar to FIG. 3 but with the snow gate in an inoperative position.

Referring now to FIGS. 3 and 4, the snow gate attachment 26 is illustrated in more detail. The snow gate attachment 26 includes a frame 28 including a bottom 30, a reinforcing box member 32 along one edge of the bottom wall 30, and a vertical side wall plate 34 extending along the other edge of the bottom wall 30. A curved member 36 extends upwardly from the bottom wall 30 and is welded along its edge to the side wall 34. This curved member 36 is provided with a flange 38 provided with bolt holes since flange 38 is the mounting bracket of the frame 28 adapted to mate with a similar flange provided on the end of the snow wing 20.

A pair of bearing members 40 and 42 are provided on the frame member 28 and a shaft 44 is journaled in the sleeve bearings 40 and 42. The shaft 44 extends through the wall plate 34, and the elongated rectangular shaped gate member 46 is fixedly mounted to the end of the shaft 44. A lever 48 is fixed to the shaft 44 intermediate the bearings 40 and 42. A cylinder and piston arrangement 50 is connected at one end to the curved member 36 and at the other end to the extremity of the lever 48. By operating the necessary controls in the cab of the grader, the piston and cylinder arrangement 50 can be actuated by fluid pressure to pivot the gate 46 from a position as shown in FIG. 3 where it is extending forwardly of the snow plow wing 20 and a plane parallel to the axis of the grader preferably, and a second position where the plate 46 extends vertically as shown in FIG. 4 and is clear of the discharge of the snow from the snow wing 20.

Figure 2:
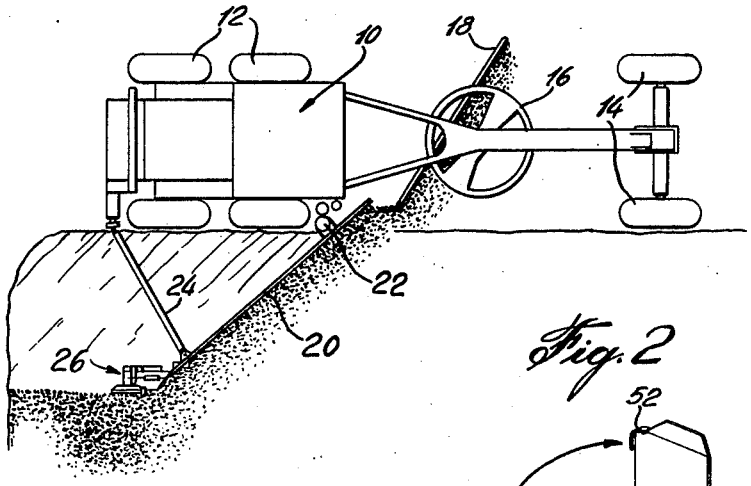
FIG. 2 is a top plan view similar to FIG. 1 with the snow gate in an inoperative position.

A shoe 52 is provided at the end of the gate blade 46 to act as a ski for the gate blade when the gate blade is in the first position shown in FIG. 3. An abutment member 54 is also mounted to the plate 46 which abuts the top of the wall plate 34 to support the gate plate 46 when it is in the downward position. In operation, as shown in FIGS. 1 and 2, the gate plate would be lowered to the position shown in FIGS. 1 and 3 only when the grader passes in front of a cross street or driveway. As it is past the cross street or driveway, as illustrated in the drawings, the operator would actuate the necessary controls to lift the gate plate 46 out of the way of the discharge of snow from the snow wing 20 as shown in FIGS. 2 and 4.

We claim:

1. A snow gate attachment for a plow blade provided on a vehicle comprising a frame, bracket means mounted on the frame for securing the frame to the free end of a plow blade, a gate member pivotally mounted to the frame, actuating means positively actuating the pivoting movement of the gate member between a first position and a second position whereby the gate member, when in the first position, will be in a horizontal position when mounted with a plow blade and extending forward of the blade to block the discharge of snow from the plow blade, the gate member being pivotable in a vertical plane parallel to the axis of the vehicle on which the plow blade is mounted for trapping snow, and a second position whereby the gate member will be clear thereof and allowing the snow to be discharged from the plow blade, the frame and gate member being mounted rearwardly of the plow blade.

2. An apparatus as defined in claim 1, wherein the frame includes flange means adapted to be mated with a similar flange means at the end of a plow blade, shaft means journaled to the frame and fixed to the gate member, actuating means mounted to the frame at one end thereof and to lever means fixed to the shaft means at the other end thereof for rotating the shaft means and thus pivoting the gate member between the first and second positions, the frame and gate member being mounted rearwardly of the plow blade permitting a clear discharge of the snow from the plow blade when the gate member is in its second position.

3. A gate member as defined in claim 2, wherein the gate member is an elongated rectangular member mounted at one end to the shaft means and normal thereto.

4. An apparatus as defined in claim 3, wherein the frame includes a guide wall in a vertical plane adapted to be juxtaposed with the gate member and for supporting said gate member in its vertical plane.

* * * * *